US005102007A

United States Patent [19]

Petterson et al.

[11] Patent Number: 5,102,007

[45] Date of Patent: Apr. 7, 1992

[54] DISPENSER FOR FOLDED SHEET PRODUCTS

[75] Inventors: Tor Petterson, Rancho Palos Verdes; Jean T. McGregor, Covina, both of Calif.

[73] Assignee: James River II, Inc., Oakland, Calif.

[21] Appl. No.: 668,083

[22] Filed: Mar. 12, 1991

[51] Int. Cl.[5] ..... B65H 1/00

[52] U.S. Cl. ..... 221/6; 221/33; 221/47

[58] Field of Search ..... 221/6, 17, 33, 53, 54, 221/56, 61-63, 48, 312 R, 52, 45; 312/60, 61

[56] References Cited

U.S. PATENT DOCUMENTS 744,047 11/1903 Casterline et al. ..... 221/53
1,179,020 4/1916 Marcuse ..... 221/54
1,898,983 2/1933 Wheeler ..... 221/312 R
3,838,663 10/1974 Focke ..... 221/6

FOREIGN PATENT DOCUMENTS 733723 7/1955 United Kingdom ..... 221/53

*Primary Examiner*—H. Grant Skaggs
*Attorney, Agent, or Firm*—Thomas R. Lampe

[57] ABSTRACT

A dispenser for folded sheet products including a housing accommodating a stack of the products, a dispenser element disposed at the lower end of the housing and having an opening through which the products are serially dispensed, and a blocking member which obstructs the interior of the housing above the stack after the stack has shortened to a predetermined degree to prevent an upward force exerted against the stack from moving the stack from dispensing position.

7 Claims, 4 Drawing Sheets

12
22
18
10
20
40
24
50
52
30
44
30
54
14

DISPENSER FOR FOLDED SHEET PRODUCTS

TECHNICAL FIELD

This invention relates to a dispenser for folded sheet products, such as paper napkins. More particularly, the dispenser includes a housing for accommodating a stack of such products. The folded sheet products are dispensed seriatim from the bottom of the stack causing depletion thereof. The dispenser incorporates blocking means which is effective upon shortening of the stack to prevent manual dislodgement of the remaining folded sheet products in the stack away from the dispenser opening.

BACKGROUND ART

It is well known in the art to dispense folded sheet products such as paper napkins from a stack of such products, and numerous devices and mechanisms for accomplishing same have been developed. Perhaps the simplest of such dispensers are those which retain a stack of such products in a vertical or near vertical orientation and rely upon the force of gravity to maintain the stack at a dispenser opening through which the products are manually withdrawn one at a time by consumers.

While gravity-fed dispensers are generally characterized by their simplicity and low cost, they also have a drawback. It will be appreciated that as a stack of paper napkins or the like is depleted during dispensing, the weight of the stack within the dispenser housing becomes less and less. In the case of gravity-fed dispensers which are manually accessed through an opening at the bottom thereof this reduction of stack weight can cause difficulties. When accessing a paper napkin to manually grasp and cause the dispensing of same a user often exerts an upward force against the lowermost napkin in the stack. When the stack itself is relatively short it can be dislodged by such activity to a position away from the dispenser opening. For example, the napkins or other folded sheet products in the stack can tip on edge and rest against a wall of the dispenser housing at a location not freely manually accessible. This can cause consumer frustration and result in more frequent servicing of the dispenser than would otherwise be required.

DISCLOSURE OF INVENTION

The dispenser which is the subject of the present application is of the gravity-fed type, incorporating all of the advantages of such construction. The dispenser, however, incorporates structure which obviates the "fall-back" problem outlined above which is characteristic of gravity-fed dispensers for folded sheet products such as paper napkins. With the dispenser of the present invention the stack of folded sheet products, including the lowermost folded sheet product in the stack, is maintained in proper dispensing position despite upwardly directed forces being applied thereto by the consumer.

The dispenser disclosed herein has an upper end and a lower end and includes walls defining an interior for accommodating a stack of folded sheet products within the interior. The folded sheet products have generally planar surfaces and the interior is of a size and configuration to allow free slidable movement of the stack of folded sheet products accommodated thereby under the influence of gravity during depletion of the stack.

A dispenser element is connected to the lower end of the housing and defines an opening in communication with the interior thereof. The opening allows manual access to a folded sheet product at the bottom of the stack.

Blocking means is operatively associated with the housing and responsive to shortening of the stack of folded sheet products during depletion thereof to a predetermined stack length to restrict upper movement of the stack within the housing interior and prevent the generally planar surfaces of the folded sheet products in the stack from engaging one of the housing walls.

The blocking means includes a blocking member movably mounted relative to the housing and movable between a first position wherein the blocking member does not interfere with movement of the stack within the housing interior and a second position wherein the blocking member projects into the housing interior.

Means is provided for biasing the blocking member toward the second position. In the arrangement disclosed herein the blocking member is pivotally connected to the housing at a location on the housing a predetermined distance from the dispenser element opening. The biasing means comprises a counter-weight connected to the blocking member and operable under the influence of gravity to urge the blocking member toward the second position.

Other features, advantages, and objects of the present invention will become apparent with reference to the following description and accompanying drawings.

BEST MODE FOR CARRYING OUT THE INVENTION

Figure 1:
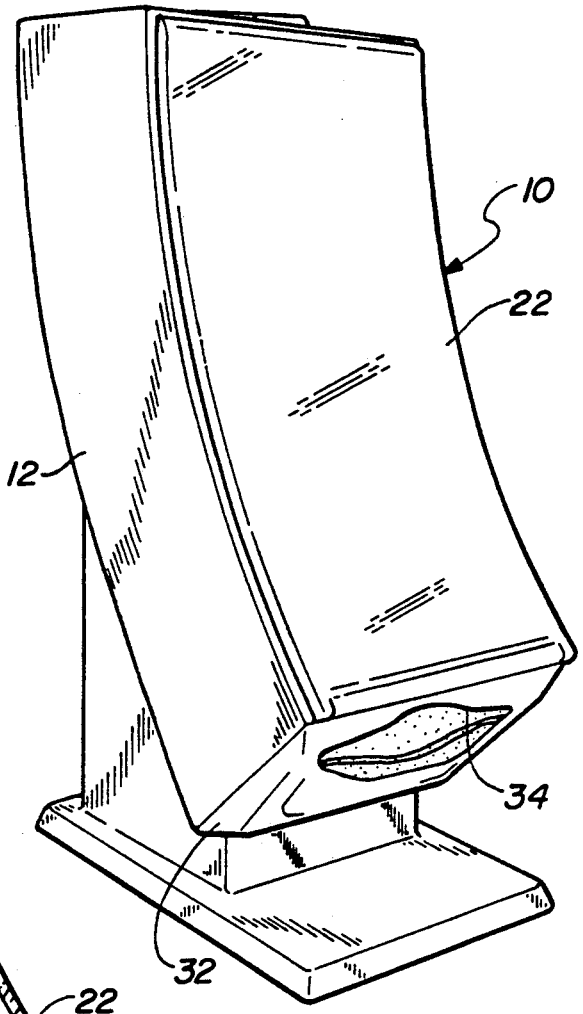
FIG. 1 is a perspective view of a dispenser constructed in accordance with the teachings of the present invention.

Referring now to drawings, and in particular FIGS. 1–4 and 6 thereof, a dispenser constructed in accordance with the teachings of the present invention is designated by reference numeral 10. Dispenser 10 includes a housing 12 mounted on a stand 14. Housing 12 has an upper and lower end and includes walls 16, 18, 20 and 22 defining an interior for accommodating a stack of folded sheet products. In the arrangement illustrated, wall 22 is in the form of a cover hinged in suitable fashion, as by means of hinge 24, to provide access to the interior by maintenance personnel. A latch mechanism 26 of any suitable type is employed to lock the cover 22 in closed position relative to the rest of the dispenser.

A stack of folded sheet products in the form of paper napkins 30 is accommodated within the housing interior. As is conventional, the paper napkins have generally planar surfaces at the tops and bottoms thereof. The interior of the housing is of a size and configuration to allow free slidable movement of the stack of paper napkins 30 under the influence of gravity during depletion of the stack. In the arrangement shown, back wall 18 is curved to provide a degree of support to the paper napkins in the stack at the edges thereof and to direct the stack to a dispenser element 32 in the form of a nose piece attached to the lower end of the housing and defining an opening 34. Opening 34 is in communication with the interior of the housing 1 and allows manual access to the paper napkin 30 at the bottom of the stack. For the purposes of the present invention, dispenser element or nose piece 32 may be of any suitable construction.

Blocking means is operatively associated with the housing 12 and responsive to shortening of the stack of folded sheet products during depletion thereof to a predetermined stack length to restrict upward movement of the stack within the housing interior and prevent the generally planar surfaces of the folded sheet products in the stack from engaging one of the housing walls. More particularly, the blocking means includes a blocking member 40 movably mounted relative to the housing and movable between a first position (the position illustrated in FIG. 2) wherein the blocking member does not interfere with the movement of the stack within the housing interior and a second position (shown in FIGS. 3 and 4) wherein the blocking member projects into the housing interior.

An aperture or opening 44 is formed in back wall 18 and the blocking member 40 passes through the aperture 44 when moving between the first and second positions. The blocking member 40 is pivotally connected to the housing 12 a predetermined distance above the opening 34. A support pin 48 is connected to the housing in any suitable manner and extends across the top of aperture 44 as shown. At its upper end blocking member 40 is curled about pin 48 to provide a hinged connection between the blocking member and the pin. That is, the blocking member is freely rotatably disposed on pin 48.

Figure 3:
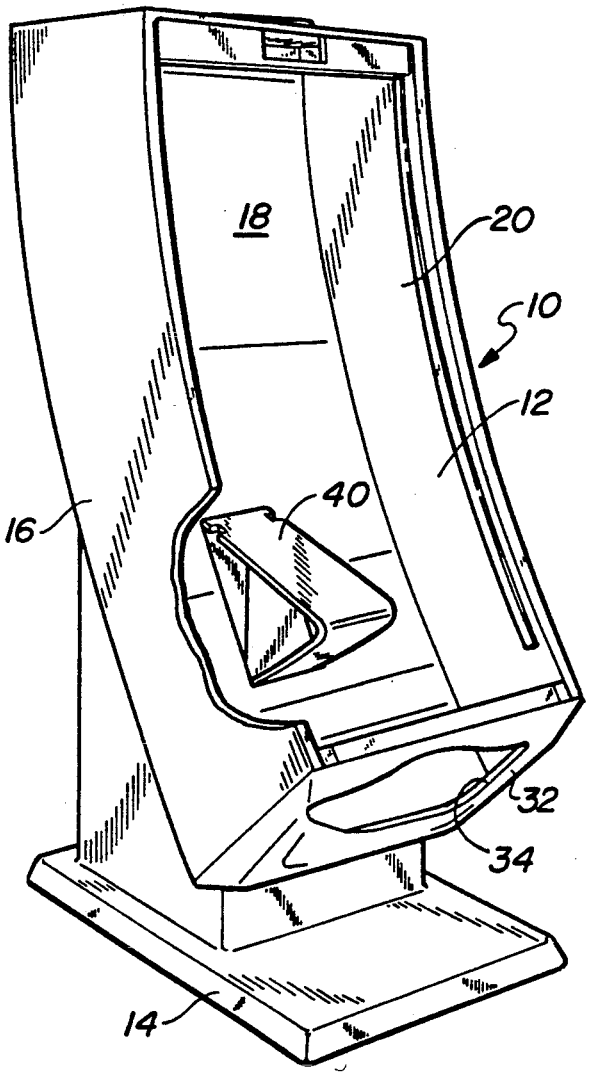
FIG. 3 is a perspective view of the dispenser with the cover removed, the dispenser housing empty of napkins, and a portion of a housing side wall broken away to better illustrate a feature of the dispenser.
Figure 6:
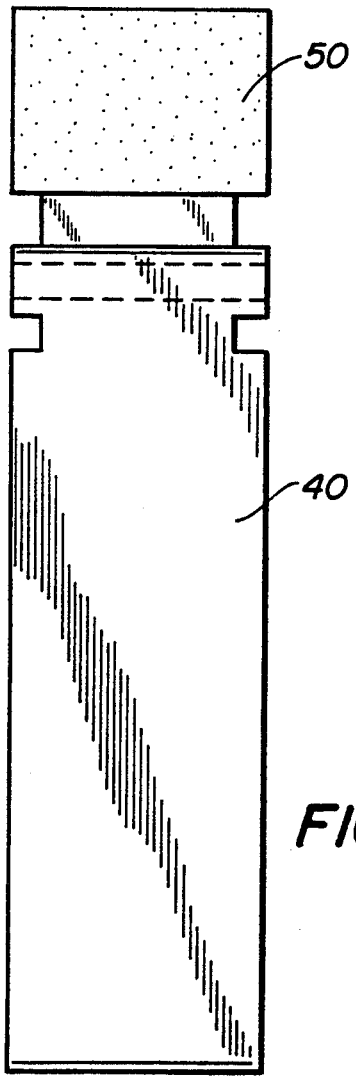
FIG. 6 is a greatly enlarged front elevation view of blocking means employed in the subject dispenser.
Figure 4:
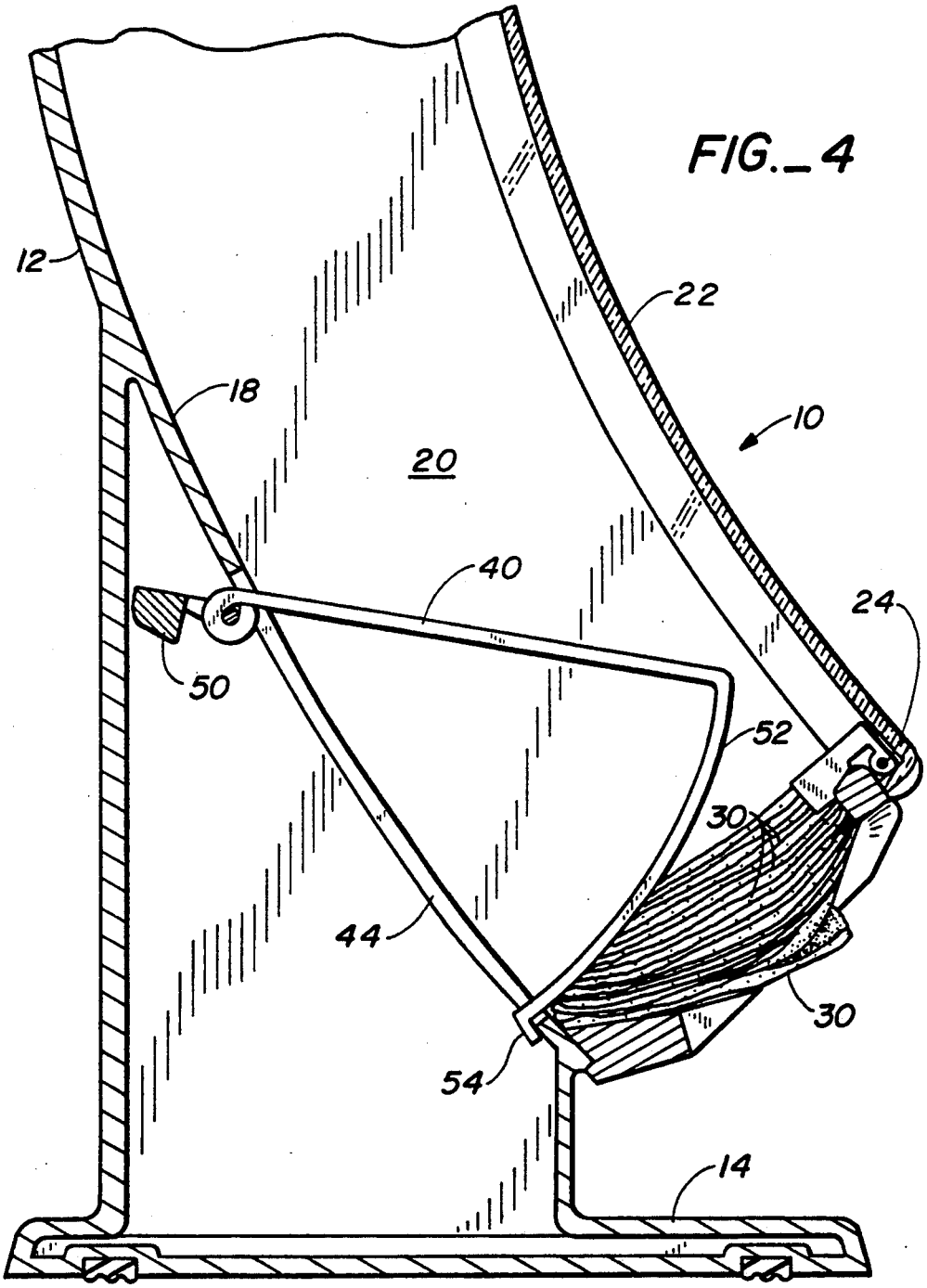
FIG. 4 is an enlarged, sectional, side view of the dispenser illustrating the position assumed by the dispenser blocking means when the stack of paper napkins has been depleted to a predetermined stack length sufficient to allow movement of the blocking means into the housing interior.

Means is provided for continuously biasing the blocking member 40 toward the second position shown in FIGS. 3 and 4. More particularly, the illustrated biasing means is in the form of a counter-weight 50 extending outwardly from pin 48 on the side thereof opposed to blocking member 40. The counter-weight may be formed of any suitable material such as lead or steel and it is operable under the influence of gravity to urge the blocking member 40 toward the second position.

Figure 2:
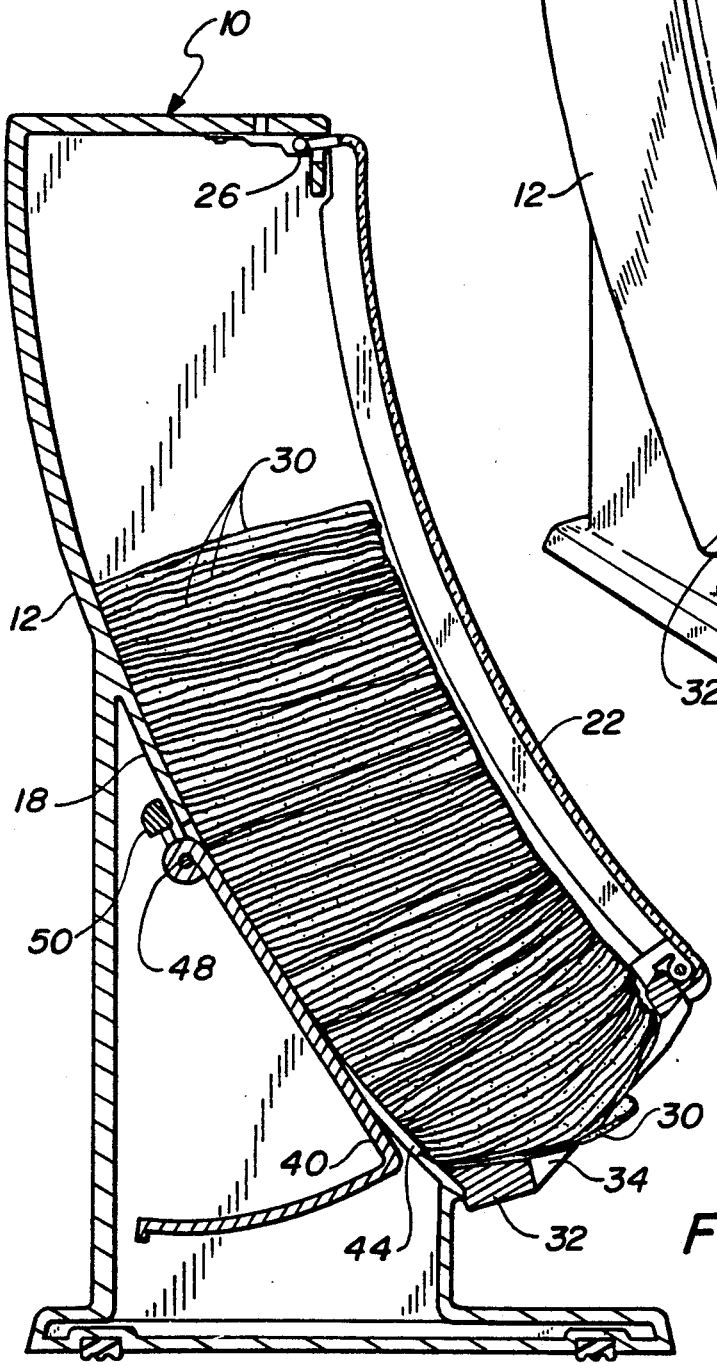
FIG. 2 is a cross-sectional, side view of the dispenser with a stack of paper napkins disposed within the interior of the dispenser housing.
Figure 5:
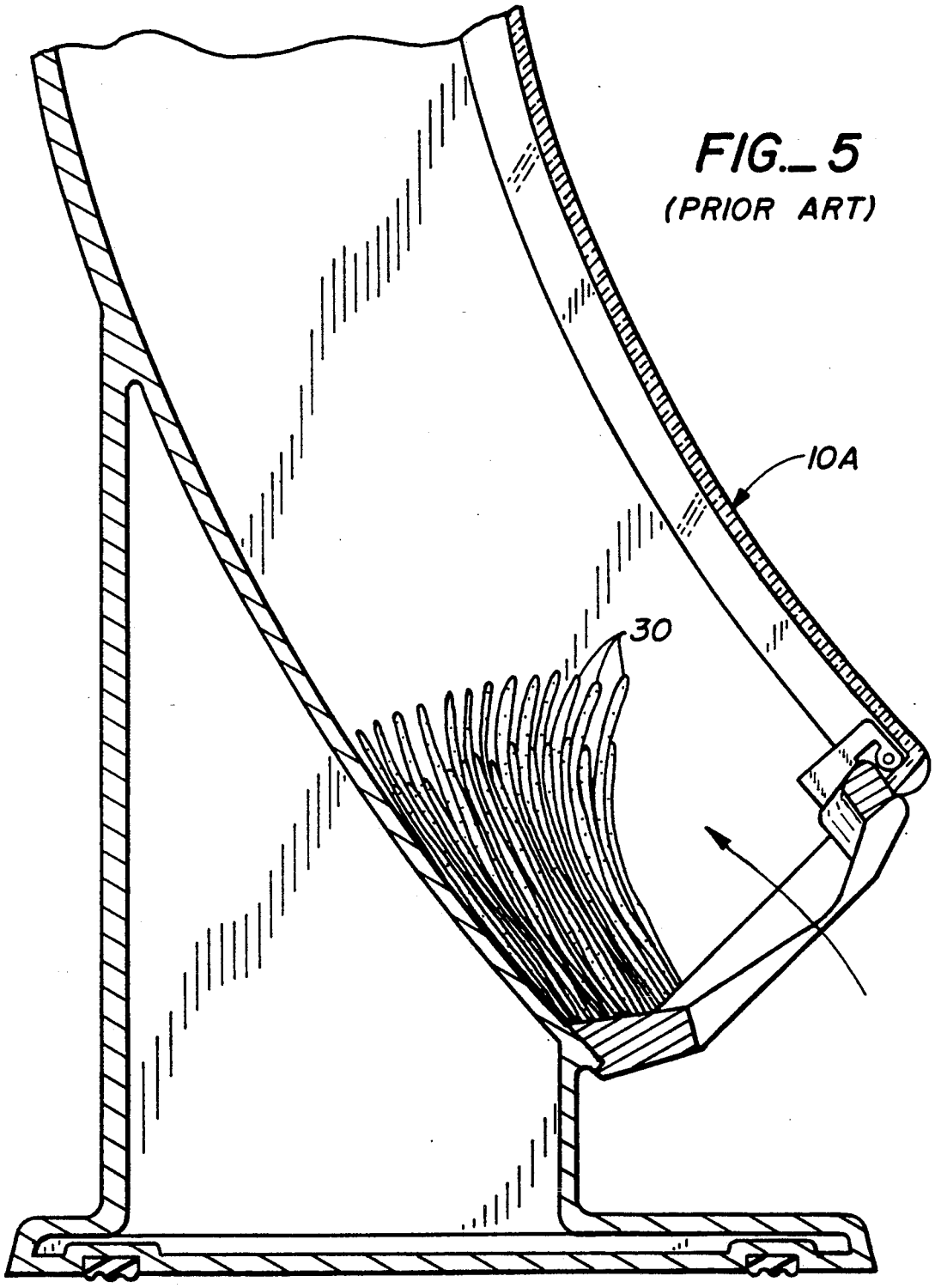
FIG. 5 (PRIOR ART)
FIG. 5 is a view similar to FIG. 4 but illustrating the "fall-back" position assumed by paper napkins in a substantially depleted stack as is a common occurrence in the prior art.

It will be appreciated that blocking member 40 is in its first position illustrated in FIG. 2 until the stack of paper napkins 30 diminishes in length to the point that the topmost napkin 30 falls below the lower end of blocking member 40. That is, blocking member 40 can move to its second position under the influence of counter-weight 50 only after the length of the stack falls below a predetermined value. When the length of the stack shrinks to the required degree, the blocking member will rotate so that it is disposed over the stack. The bottom 52 of the blocking member 40 will thus interfere with and prevent significant upward movement of the few paper napkins 30 remaining in the stack. If an upwardly directed force is applied to the lowermost paper napkin 30, the stack cannot be significantly dislodged from its dispensing position within the housing and relative to the dispenser element opening. This is to be compared with the prior art situation shown in FIG. 5 wherein a dispenser 10A does not incorporate blocking means. In FIG. 5 the paper napkins 30 are shown as having been previously dislodged by a force exerted against the lowermost napkin in a stack in the direction of the arrow. This force has caused the paper napkins to essentially stand on end with the planar surface of the previously topmost napkin resting against the surface of the dispenser back wall. A consumer will have great difficulty extracting a napkin under these conditions.

Returning now to FIGS. 1–4 and 6, a protrusion or lip 54 projects from the distal end of blocking member bottom 52. Such protrusion is engageable with the wall 18 where the wall defines the lower limit of aperture 44. Such engagement ensures that the counter-weight 50 will not cause the blocking member 40 to extend any further into the interior of housing 12 than is desired.

The blocking member will not interfere with napkin reloading nor is it necessary for the person performing the reloading activity to take any special steps to remove the blocking member from the housing interior. This is accomplished automatically by the napkins themselves during the refill operation. That is, the refill napkins will bear against the blocking member and cause the blocking member to swing back to the position shown in FIG. 2 against the bias of the counter-weight.

We claim:

1. In combination:

a housing having an upper and lower end and including walls defining an interior for accommodating a stack of folded sheet products within said interior, said folded sheet products having generally planar surfaces and edges, and said interior being of a size and configuration to allow free slidable movement of the stack or folded sheet products accommodated thereby under the influence of gravity during depletion of said stack;

a dispenser element connected to the lower end of said housing and defining an opening in communication with said interior, said opening allowing manual access to a folded sheet product at the bottom of said stack; and blocking means operatively associated with said housing and responsive to shortening of said stack of folded sheet products during depletion thereof to a predetermined stack length to restrict upward movement of the stack within said housing interior and positively prevent the generally planar surfaces of the folded sheet products in the stack from engaging one of said walls, said blocking means including a blocking member movably mounted relative to said housing and movable between a first position wherein said blocking member is substantially out of said housing interior and does not interfere with movement of said stack within said housing interior until the stack is depleted to said predetermined stack length and a second position wherein said blocking member projects into said housing interior, said blocking means additionally including means biasing said blocking member toward said second position, one of said housing walls defining an aperture spaced from said dispenser element opening, said blocking member passing through said aperture when moving between said first and second positions, and said blocking member engaging the edges of napkins in said stack to prevent movement of said blocking member from said first position to said second position until the stack is depleted to said predetermined stack length, and said blocking member engageable by the generally planar surfaces of said napkins to positively prevent upward movement thereof only after the stack is depleted to said predetermined stack length.

2. The combination according to claim 1 wherein said blocking member is pivotally connected to said housing at a location on said housing a predetermined distance from said dispenser element opening, said biasing means comprising a counterweight connected to said blocking member operable under the influence of gravity to urge said blocking member toward said second position.

3. The combination according to claim 1 additionally comprising hinge means pivotally connecting said blocking member to said housing, said blocking member being pivotally movable about said hinge means when moving between said first and second positions.

4. The combination according to claim 3 wherein said blocking means has a bottom surface extending outwardly from said aperture and into said housing interior over said stack of folded sheet products when said blocking member is in said second position.

5. The combination according to claim 4 wherein said blocking member additionally includes means for limiting the distance the bottom surface extends into the housing interior when the blocking member is in said second position.

6. The combination according to claim 5 wherein said limiting means comprises a protrusion engageable with the housing wall defining said aperture.

7. The combination according to claim 1 wherein the wall defining said aperture is a smoothly curved rear wall engaging the edges of folded sheet products in said stack.

* * * * *